US007628626B1

(12) United States Patent
Tseng

(10) Patent No.: US 7,628,626 B1
(45) Date of Patent: Dec. 8, 2009

(54) EASY-TO-REMOVE PLUG

(75) Inventor: Tien-Chung Tseng, Hsichih (TW)

(73) Assignee: Wistron Corporation (TW)

( * ) Notice: Subject to any disclaimer, the term of this patent is extended or adjusted under 35 U.S.C. 154(b) by 0 days.

(21) Appl. No.: 12/425,872

(22) Filed: Apr. 17, 2009

(30) Foreign Application Priority Data

Jun. 2, 2008 (TW) ..... 97209651 U

(51) Int. Cl.
*H01R 13/62* (2006.01)

(52) U.S. Cl. ..... 439/160

(58) Field of Classification Search ..... 439/160, 439/159, 152
See application file for complete search history.

(56) References Cited

U.S. PATENT DOCUMENTS 2,430,011 A * 11/1947 Gillentine ..... 439/160
5,975,930 A * 11/1999 Matsuura et al. ..... 439/157

* cited by examiner

*Primary Examiner*—Phuong K Dinh
(74) *Attorney, Agent, or Firm*—Hancock Hughey LLP

(57) ABSTRACT

An easy-to-remove plug for insertion into a socket includes a body, two conducting plates extending forwardly and spacedly from a front end of the body, a shell sleeved on the body and movable forwardly and rearwardly relative to the body, and at least one linkage set. The linkage set is connected pivotally to one of the body and the shell, and has a force-bearing end and an abutting end. The force-bearing end has a connective relationship with the other of the body and the shell. When a force is applied to the shell to enable the shell to move rearwardly relative to the body, the force is borne by the force-bearing end and drives the linkage set to pivot so as to bring the abutting end to abut against the socket for separating the two conducting plates from the socket.

18 Claims, 4 Drawing Sheets

EASY-TO-REMOVE PLUG

CROSS-REFERENCE TO RELATED APPLICATION

This application claims priority of Taiwanese Application No. 097209651, filed on Jun. 2, 2008.

BACKGROUND OF THE INVENTION

1. Field of the Invention

The invention relates to a plug, more particularly to an easy-to-remove plug.

2. Description of the Related Art

Generally speaking, after a plug is plugged into a socket or outlet, if it is desired to remove the plug from the socket, a proper way is for a user to hold any part of the plug with one hand and pull the plug outwardly. However, since it is relatively difficult to remove the plug in the proper way, the user often holds a power wire connected to the plug and directly pulls out the plug, which is likely to result in damage to or breaking of the power wire.

Referring to FIG. 1, Taiwanese Utility Model No. M307903 discloses an easy-to-remove plug 1, which includes a plug body 11 and a press rod 12 connected pivotally to the plug body 11. If it is desired to remove the easy-to-remove plug 1 from a socket (not shown), one end 121 of the press rod 12 is depressed to cause the end 121 to pivot downwardly and to cause another end 122 of the press rod 12 to simultaneously push forwardly against the socket, so that the plug body 11 is detached and removed in a direction away from the socket.

However, although the aforesaid easy-to-remove plug 1 achieves the purpose of force-saving, since the press rod 12 must be depressed when removing the plug 1, which is different from the conventional way of holding any part of a plug and then pulling out the plug, the user needs to change the way he/she usually removes a plug when using the easy-to-remove plug 1, which is quite inconvenient.

SUMMARY OF THE INVENTION

Therefore, an object of the present invention is to provide an easy-to-remove plug that is removable in a conventional way.

Accordingly, the easy-to-remove plug of this invention is for insertion into a socket. The plug includes a body, two conducting plates extending forwardly and spacedly from a front end of the body, a shell sleeved on the body and movable forwardly and rearwardly relative to the body, and at least one linkage set. The linkage set is connected pivotally to one of the body and the shell, and has a force-bearing end and an abutting end. The force-bearing end has a connective relationship with the other of the body and the shell. When a force is applied to the shell to enable the shell to move rearwardly relative to the body, the force is borne by the force-bearing end and drives the linkage set to pivot so as to bring the abutting end to abut against the socket for separating the two conducting plates from the socket.

Preferably, the force-bearing end is provided with one of a first guide slot and a first guide post. The other of the body and the shell is provided with the other of the first guide slot and the first guide post.

Preferably, the linkage set is connected pivotally to the body, and the force-bearing end has a connective relationship with the shell.

The linkage set includes a first rod with two ends. The first rod is connected pivotally to the body at a position between the two ends of the first rod. The force-bearing end and the abutting end are located respectively at the two ends of the first rod. Upon application of the force to the shell to enable the shell to move rearwardly relative to the body, the first guide slot and the first guide post cooperate to move the force-bearing end of the first rod so as to drive the first rod to pivot to bring the abutting end of the first rod to abut against the socket for separating the conducting plates from the socket.

Alternatively, the linkage set includes a first rod with two ends, and a second rod. The first rod is connected pivotally to the body at a position between the two ends of the first rod. The force-bearing end is located at one of the ends of the first rod, and the other of the ends of the first rod is connected pivotally to one end of the second rod. The abutting end is located at the other end of the second rod. One of the body and the shell is provided with a guiding portion for limiting when the second rod is moved forwardly and rearwardly relative to the body. Upon application of the force to the shell to enable the shell to move rearwardly relative to the body, the first guide slot and the first guide post cooperate to move the force-bearing end of the first rod so as to drive the first rod to pivot and so as to drive the second rod to enable the second rod to move under guidance of the guiding portion, such that the abutting end of the second rod abuts against the socket for separating the conducting plates from the socket. Preferably, the other of the ends of the first rod is provided with a second guide slot, and said one end of the second rod is provided with a second guide post for insertion into the second guide slot. The guiding portion includes guide rails provided on the body and located respectively on two sides of the second rod.

Preferably, the first guide slot is located in the shell, and the first guide post is located at the force-bearing end.

Preferably, the body is provided with a stop block. The stop block limits the pivoting angle of the first rod.

Preferably, the shell is provided with an annular recess for facilitating gripping by a user.

Preferably, the easy-to-remove plug includes two linkage sets connected pivotally and respectively to two opposite sides of the body, and the first rods of the two linkage sets pivot in opposite directions.

The effect of the invention resides in that, by virtue of the connective relationship between the force-bearing end of the linkage set and the other of the body and the shell, when a force is applied to the shell to enable the shell to move rearwardly relative to the body, the force is borne by the force-bearing end and drives the linkage set to pivot so as to bring the abutting end of the linkage set to abut against the socket for separating the two conducting plates from the socket. Thus, the object of permitting easy removal of the plug in the conventional way can be achieved.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
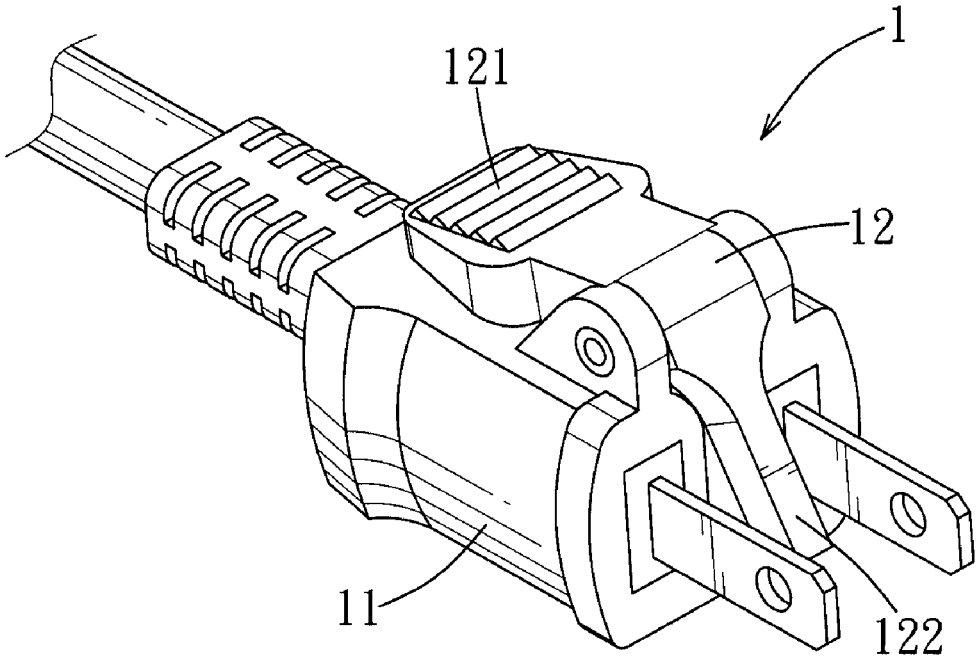
FIG. 1 PRIOR ART
FIG. 1 is a perspective view to illustrate a conventional easy-to-remove plug.

Before the present invention is described in greater detail, it should be noted that like elements are denoted by the same reference numerals throughout the disclosure.

Figure 2:
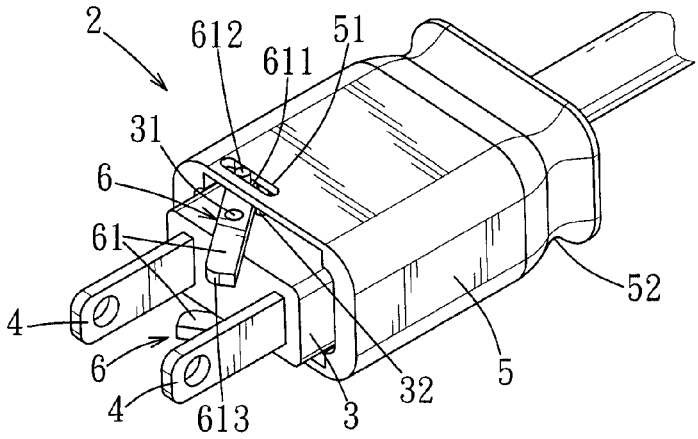
FIG. 2 is a perspective view to illustrate a first preferred embodiment of an easy-to-remove plug according to the present invention.
Figure 3:
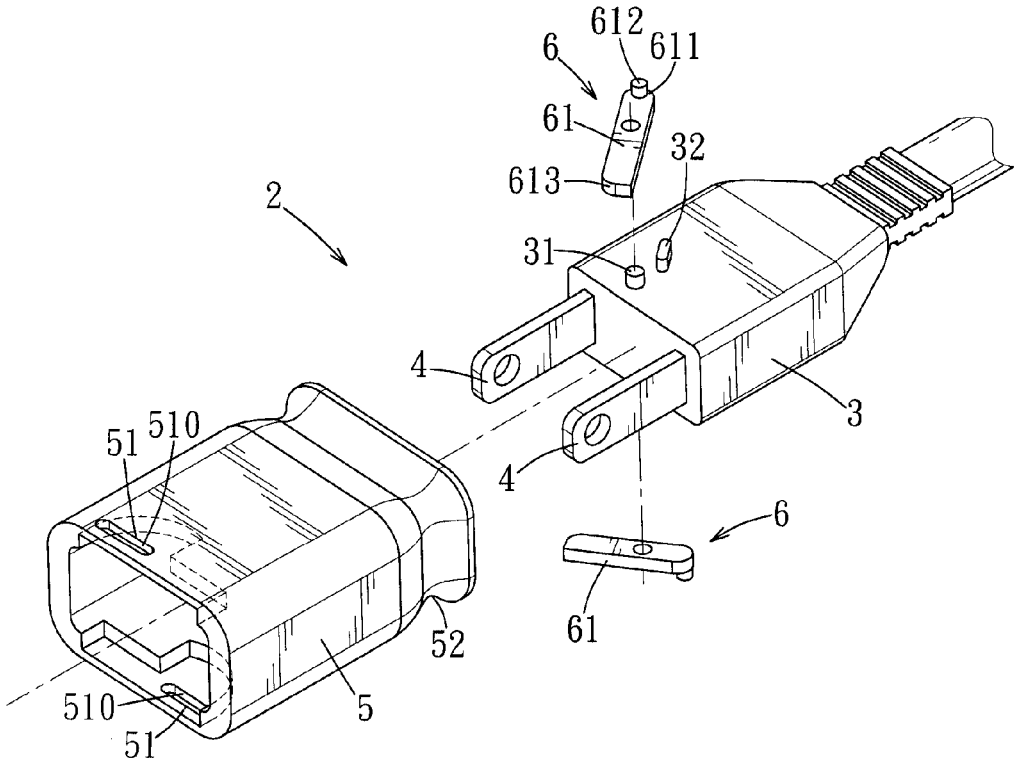
FIG. 3 is an exploded perspective view of the first preferred embodiment.

Referring to FIGS. 2 and 3, the first preferred embodiment of an easy-to-remove plug 2 according to the present invention includes a body 3, two conducting plates 4 extending forwardly and spacedly from a front end of the body 3, a shell 5 sleeved on the body 3 and movable forwardly and rearwardly relative to the body 3, and two linkage sets 6 located on upper and lower sides of the body 3.

The body 3 has upper and lower sides, each of which is provided with a pivot shaft 31 and a stop block 32. The shell 5 includes two first guide slots 51 defined respectively by slot defining walls 510, and an annular recess 52 provided in a rear portion of the shell 5 for facilitating gripping by a user.

Each of the linkage sets 6 includes a first rod 61. The first rod 61 has a force-bearing end 611 and an a butting end 613. The first rod 61 is connected pivotally to the pivot shaft 31 of the body 3 at a point between the force-bearing end 611 and the abutting end 613 of the first rod 61. The force-bearing end 611 of the first rod 61 has a first guide post 612 that is inserted into a corresponding one of the first guide slots 51.

Figure 4:
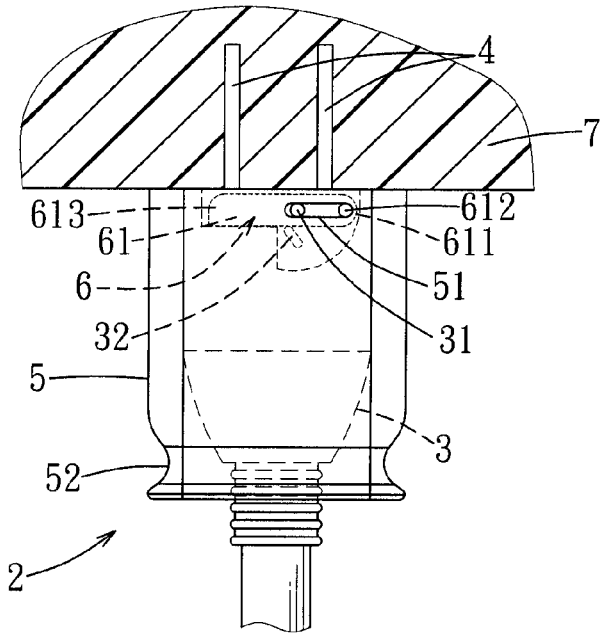
FIG. 4 is a top view to illustrate the first preferred embodiment when inserted into a socket.

Reference is made to FIG. 4, which is a schematic view illustrating that the easy-to-remove plug 2 is completely inserted into a socket 7. At this time, the front ends of the body 3 and the shell 5 are flush with each other and abut against an outer surface of the socket 7, and the conducting plates 4 are entirely accommodated in the socket 7.

Figure 5:
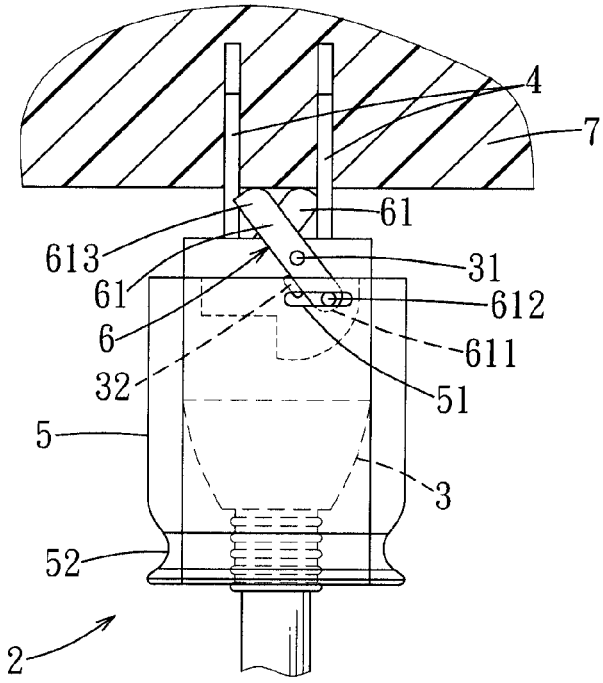
FIG. 5 is a view similar to FIG. 4, illustrating how the first preferred embodiment is removed from the socket.

Referring to FIG. 5, when it is desired to pull out the easy-to-remove plug 2 from the socket 7, a force is applied to the shell 5 to enable the shell 5 to move rearwardly relative to the body 3. Hence, the slot-defining wall 510 of each of the first guide slots 51 moves the first guide post 612 at the force-bearing end 611 of the first rod 61 of a respective one of the linkage sets 6, so that the first rod 61 is pivoted about the respective pivot shaft 31 of the body 3, thereby enabling the abutting ends 613 of the first rods 61 to abut against the outer surface of the socket 7 for separating the conducting plates 4 from the socket 7. When each of the first rods 61 pivots, the pivoting angle is limited by the respective stop block 32 of the body 3.

It is particularly noted that the pivoting directions of the two first rods 61 on the upper and lower sides of the body 3 are opposite to each other. Thus, the abutting force exerted on the socket 7 can be more evenly distributed. However, although two first rods 61 are provided in this embodiment, there may be only one first rod 61, that is, the body 3 is pivotally provided with only one first rod 61 on the upper or lower side thereof.

In this embodiment, although the first rods 61 are connected pivotally to the body 3, and the force-bearing ends 611 have a connective relationship with the shell 5, the first rods 61 may be connected pivotally to the shell 5, with the force-bearing ends 611 having a connective relationship with the body 3. In other words, the linkage sets 6 may be provided pivotally on the body 3 or on the shell 5.

In addition, in this embodiment, although the first guide posts 612 are provided respectively on the first rods 61, and the first guide slots 51 are provided in the shell 5, the first guide posts 612 and the first guide slots 51 may be arranged interchangeably and are not limited to the disclosure herein. Furthermore, the aforesaid connective relationship is not necessarily realized by the arrangement of the guide slots and guide posts in other embodiments of this invention.

Figure 6:
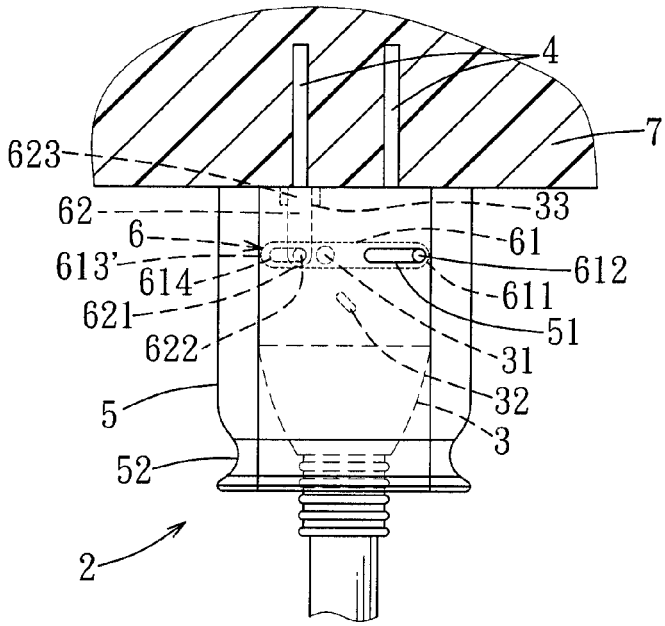
FIG. 6 is a top view to illustrate a second preferred embodiment of an easy-to-remove plug according to the present invention when inserted into a socket.
Figure 7:
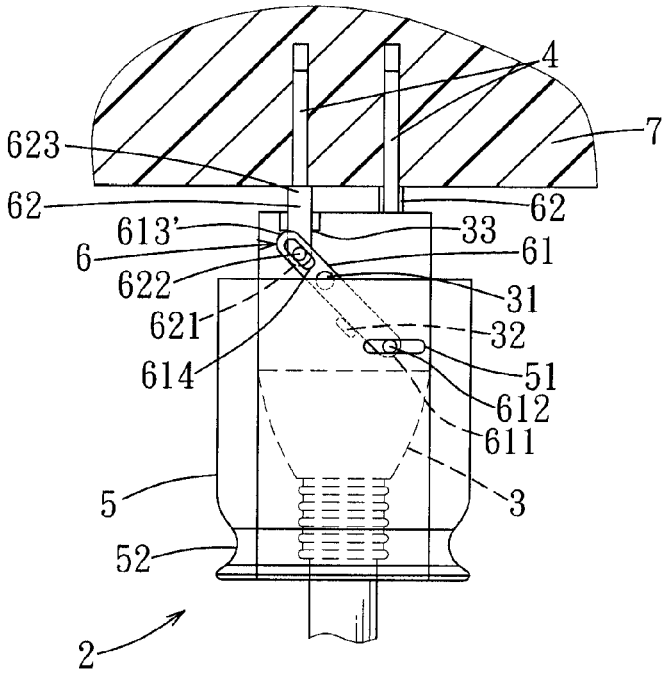
FIG. 7 is a view similar to FIG. 6, illustrating how the second preferred embodiment is removed from the socket.

Referring to FIGS. 6 and 7, the second preferred embodiment of an easy-to-remove plug 2 according to this invention is substantially the same as the first preferred embodiment. A major difference is that each of the linkage sets 6 of this embodiment further includes a second rod 62 in addition to the first rod 61. The first rod 61 has a force-bearing end 611 and another end 613'. The second rod 62 has an end 621 connected to said another end 613' of the first rod 61, and an abutting end 623.

Reference is made to FIG. 6, which is a schematic view illustrating that the easy-to-remove plug 2 is completely inserted into the socket 7. At this time, the front ends of the body 3 and the shell 5 are flush with each other and abut against the outer surface of the socket 7, while the conducting plates 4 are entirely accommodated in the socket 7.

Referring to FIG. 7, when it is desired to pull out the easy-to-remove plug 2 from the socket 7, a force is applied to the shell 5 to enable the shell 5 to move rearwardly relative to the body 3, whereby the slot-defining walls 510 respectively defining the first guide slots 51 in the shell 5 move the first guide posts 612 at the force-bearing ends 611 of the first rods 61 of the linkage sets 6 so that the first rod 61 of each of the linkage sets 6 pivots about the respective pivot shaft 31 of the body 3, and a slot-defining wall defining a second guide slot 614 in said another end 613' of the first rod 61 of each of the linkage sets 6 drives a second guide post 622 at the end 621 of the second rod 62 of the respective linkage set 6 to enable the second rod 62 to be guided by a guiding portion 33 to move forwardly relative to the body 3. Finally, the abutting ends 623 of the second rods 62 of the linkage sets 6 abut against the socket 7 for separating the conducting plates 4 from the socket 7. In this embodiment, the guiding portion 33 includes guide rails provided respectively on two sides of the second rod 62 of each of the linkage sets 6.

Similar to the first preferred embodiment, the linkage sets 6 of the second preferred embodiment may be provided pivotally on the body 3 or on the shell 5.

It is disclosed in the aforesaid first and second preferred embodiments that each of the linkage sets 6 includes one rod (i.e., the first embodiment) or two rods (i.e., the second embodiment). However, the number of rods included in each linkage set 6 should not be limited to the above disclosure, as long as the force-bearing ends of the linkage sets 6 are able to move the linkage sets 6 to enable the abutting ends to abut against the socket 7 when subjected to a force.

In sum, by virtue of the cooperation between the first guide posts 612 at the force-bearing ends 611 of the linkage sets 6 and the first guide slots 51 in the shell 5, when a force is applied to the shell 5 to enable the shell 5 to move rearwardly relative to the body 3, the force is borne by the force-bearing ends 611 and drives the respective linkage set 6 to pivot so as to bring the abutting ends 613, 623 of the linkage sets 6 to abut against the socket 7 for separating the conducting plates 4 from the socket 7, thereby permitting easy removal of the plug 2 in the conventional way.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An easy-to-remove plug for insertion into a socket, said easy-to-remove plug comprising:

a body having a front end;

two conducting plates extending forwardly and spacedly from said front end of said body;

a shell sleeved on said body and movable forwardly and rearwardly relative to said body; and at least one linkage set connected pivotally to one of said body and said shell, said linkage set having a force-bearing end and an abutting end;

said force-bearing end having a connective relationship with the other of said body and said shell, wherein, upon application of a force to said shell to enable said shell to move rearwardly relative to said body, the force is borne by said force-bearing end and drives said linkage set to pivot so as to bring said abutting end to abut against said socket for separating said conducting plates from the socket.

2. The easy-to-remove plug according to claim 1, wherein said force-bearing end is provided with one of a first guide slot and a first guide post, the other of said body and said shell being provided with the other of said first guide slot and said first guide post.

3. The easy-to-remove plug according to claim 2, wherein said linkage set is connected pivotally to said body, and said force-bearing end has a connective relationship with said shell.

4. The easy-to-remove plug according to claim 3, wherein said linkage set includes a first rod with two ends, said first rod being connected pivotally to said body at a position between said two ends of said first rod, said force-bearing end and said abutting end being located respectively at said two ends of said first rod, and wherein, upon application of the force to said shell to enable said shell to move rearwardly relative to said body, said first guide slot and said first guide post cooperate to move said force-bearing end of said first rod so as to drive said first rod to pivot to bring said abutting end of said first rod to abut against the socket for separating said conducting plates from the socket.

5. The easy-to-remove plug according to claim 3, wherein said linkage set includes a first rod with two ends, and a second rod, said first rod being connected pivotally to said body at a position between said two ends of said first rod, said force-bearing end being located at one of said ends of said first rod, the other of said ends of said first rod being connected pivotally to one end of said second rod, said abutting end being located at the other end of said second rod, one of said body and said shell being provided with a guiding portion for limiting when said second rod is moved forwardly and rearwardly relative to said body, and wherein, upon application of the force to said shell to enable said shell to move rearwardly relative to said body, said first guide slot and said first guide post cooperate to move said force-bearing end of said first rod so as to drive said first rod to pivot and so as to drive said second rod to enable said second rod to move under guidance of said guiding portion such that said abutting end of said second rod abuts against the socket for separating said conducting plates from the socket.

6. The easy-to-remove plug according to claim 5, wherein the other of said ends of said first rod is provided with a second guide slot, and said one end of said second rod is provided with a second guide post for insertion into said second guide slot.

7. The easy-to-remove plug according to claim 4, wherein said first guide slot is located in said shell, and said first guide post is located at said force-bearing end.

8. The easy-to-remove plug according to claim 7, wherein said body is provided with a stop block, said stop block limiting a pivoting angle of said first rod.

9. The easy-to-remove plug according to claim 8, wherein said shell is provided with an annular recess for facilitating gripping by a user.

10. The easy-to-remove plug according to claim 5, wherein said first guide slot is located in said shell, and said first guide post is located at said force-bearing end.

11. The easy-to-remove plug according to claim 10, wherein said body is provided with a stop block, said stop block limiting a pivoting angle of said first rod.

12. The easy-to-remove plug according to claim 11, wherein said shell is provided with an annular recess for facilitating gripping by a user.

13. The easy-to-remove plug according to claim 5, wherein said guiding portion includes guide rails provided on said body and located respectively on two sides of said second rod.

14. The easy-to-remove plug according to claim 3, comprising two of said linkage sets, said two linkage sets being connected pivotally and respectively to two opposite sides of said body.

15. The easy-to-remove plug according to claim 4, comprising two of said linkage sets, said two linkage sets being connected pivotally and respectively to two opposite sides of said body.

16. The easy-to-remove plug according to claim 15, wherein said first rods of said two linkage sets pivot in opposite directions.

17. The easy-to-remove plug according to claim 5, comprising two of said linkage sets, said two linkage sets being connected pivotally and respectively to two opposite sides of said body.

18. The easy-to-remove plug according to claim 17, wherein said first rods of said two linkage sets pivot in opposite directions.

* * * * *